United States Patent [19]

Brady

[11] Patent Number: 4,831,341

[45] Date of Patent: May 16, 1989

[54] MAGNETRON WITH TUNING MEMBER MOVEABLE BY PASSING CURRENT THROUGH IT

[75] Inventor: Michael B. C. Brady, Maldon, United Kingdom

[73] Assignee: English Electric Valve Company Limited, Chelmsford, United Kingdom

[21] Appl. No.: 146,382

[22] Filed: Jan. 21, 1988

[30] Foreign Application Priority Data

Jan. 21, 1987 [GB] United Kingdom ..... 8701235

[51] Int. Cl.[4] ..... H01J 23/213

[52] U.S. Cl. ..... 331/90; 315/39.61

[58] Field of Search ..... 331/90; 315/39.55, 39.61

[56] References Cited

U.S. PATENT DOCUMENTS 2,462,137 2/1949 Smith .
2,462,869 3/1949 Kather .
4,331,935 5/1982 Thornber ..... 331/90

FOREIGN PATENT DOCUMENTS 0133727 3/1985 European Pat. Off. .
968094 1/1958 Fed. Rep. of Germany .
57-136737 8/1982 Japan .
734562 8/1955 United Kingdom .
1219990 1/1971 United Kingdom .
1349354 4/1974 United Kingdom .
1381727 1/1975 United Kingdom .
2106309 4/1983 United Kingdom .

*Primary Examiner*—Siegfried H. Grimm
*Attorney, Agent, or Firm*—Lowe, Price, LeBlanc, Becker & Shur

[57] ABSTRACT

A magnetron includes a cathode and vane type anode structure. The frequency of oscillation of a microwave output signal of the magnetron is tunable by means of a tuning member, which is in the form of an annular plate arranged adjacent resonant cavities of the magnetron. The frequency of oscillation is determined by the position of the tuning member relative to the resonant cavities. When it is wished to tune the magnetron output frequency a current is passed along a path defined by the tuning member. This causes axial forces to be exerted on the tuning member so that it moves. Since the current is arranged to pass through the tuning member itself, the device is particularly simple, no actuating mechanisms or drive coils, for example, being necessary.

10 Claims, 4 Drawing Sheets

MAGNETRON WITH TUNING MEMBER MOVEABLE BY PASSING CURRENT THROUGH IT

FIELD OF THE INVENTION

This invention relates to magnetrons and more particularly to the tuning of the frequency of oscillation of a microwave output signal of a magnetron.

BACKGROUND OF THE INVENTION

A magnetron produces a microwave output signal, the frequency of which is primarily dependent on the frequency characteristics of a resonant cavity associated with the magnetron. In a number of applications it is desirable that the frequency of oscillation can be adjusted or tuned. Previously, tuning of the oscillation frequency has been achieved by including a tuner connected to relatively complex actuator mechanisms such as mechanical linkages and bellows. Such an arrangement is difficult to fabricate and is thus expensive.

SUMMARY OF THE INVENTION

The present invention seeks to provide relatively simple, compact apparatus which is inexpensive to fabricate and which permits effective tuning of the magnetron output frequency.

According to the invention there is provided a magnetron comprising a tuning member arranged in a magnetic field and movable relative to a resonant cavity, the frequency of oscillation of a microwave output signal being dependent on the position of the tuning member; and means arranged to transmit a current along a path substantially normal to a component of the magnetic field and defined by the tuning member, whereby the position of the tuning member is controlled. By employing the invention, movement of the tuning member may be effected without the need for actuator mechanisms such as drive coils and mechanical linkages for example, in addition to the tuning member. Tuning may therefore be achieved with a relatively simple, and therefore inexpensive arrangement. Since only the tuning member itself is required, and not any additional actuating mechanisms, the inertia of the tuning device is small and thus only a small force is required to obtain the necessary movement. It has been found that typically, at an operating frequency of about 3GHz, tuning may be carried out over a range of about 80MHz. The tuning member can be of low impedence and thus a large tuner current can be easily produced. It has been found that the invention may be put into effect without significantly changing existing magnetron designs, and that a magnetron in accordance with the invention may be arranged to be of substantially the same outline and size as a magnetron in which tuning is not provided.

When current flows through the tuning member, a force is exerted on the tuning member which is in a direction mutually orthoganal to the current direction and a component of the magnetic field. The magnitude of the force is dependent on the current magnitude, the magnitude of the component of the magnetic field normal to the tuning member and the length of the current path. The magnetron may be, for example, of the type having an annular cavity in which an anode is co-axially arranged about a cathode. Magnetic pole pieces are axially arranged on each side of the cathode/anode structure to produce a generally axial magnetic field in the interaction space of the magnetron, where electrons interact with magnetic and dc electric fields during operation of the magnetron. The tuning member may conveniently be an annular plate arranged about the axis and adjacent the resonant cavities. In the arrangement described, forces exerted on the tuning member which result from the axial magnetic field component cancel out because of the circular symmetry of the tuning member, and forces due to the radial magnetic component produce movement in an axial direction. Thus tuning of the frequency of oscillation of the output signal may be readily achieved.

It may be thought that, since the magnetic pole pieces have been arranged in previous magnetrons solely with the intention of producing a strong axial field in the interaction region, that it would prove necessary to re-design the pole pieces to enable the invention to be effectively put into operation. However, it has been found that, in a conventionally designed magnetron, the radial magnetic field component at the ends of the cathode/anode structure is sufficiently large, at about a third of the axial magnetic field component at the interaction space, to enable sufficient force to be exerted on the tuning member to obtain the required movement.

If it is wished to increase the radial magnetic field component further, advantageously, additional magnetic material is included to modify the magnetic field. For example, rings of magnetic material may be placed outside the magnetron vacuum envelope to attract the fringing field sideways.

The current through the tuning member may be ac or dc. By using a dc current it is possible to maintain the tuning member at a particular position, but this may reduce the speed of tuning by an unacceptable amount. The use of an ac current enables agile frequency tuning to be implemented. The driving waveform of the current need not be limited to a sinusoidal shape and the tuning member may be tuned at variable frequencies from dc to mid-audio frequencies. Normally the tuning member will be driven away from and generally at a frequency less than the mechanical resonant frequency of the tuning member system. If the tuning assembly is driven at its mechanical resonant frequency, the energy required will be less but the tuning frequency response tends to then be limited.

The tuning member is preferably substantially planar, the particular shape of a tuning member plate depending on the type of magnetron it is to be used in. For example the magnetron may be of the anode vane type, hole and slot anode or a rising sun construction. Advantageously, the tuning member includes an indentation in its surface, thus increasing the current path length and thereby increasing the available tuning range for a particular amount of movement of the tuning member. The indentations may be round or sector shaped for example. In one embodiment of the invention the tuning member is in the form of a split annular plate having an extension portion or leg on each side of the split, the tuning member being pivoted at the other ends of the legs. The legs may be clamped, movement of the tuning member being possible because of the flexability of its material.

In a co-axial magnetron, current in the tuning member may be arranged to interact with the radial field from the sides of the body of the magnetic pole pieces to tune the outer cavity.

BRIEF DESCRIPTION OF THE DRAWINGS

Some ways in which the invention may be performed are now described with reference to the accompanying drawings, in which.

DESCRIPTION OF THE PREFERRED EMBODIMENTS

Figure 1:
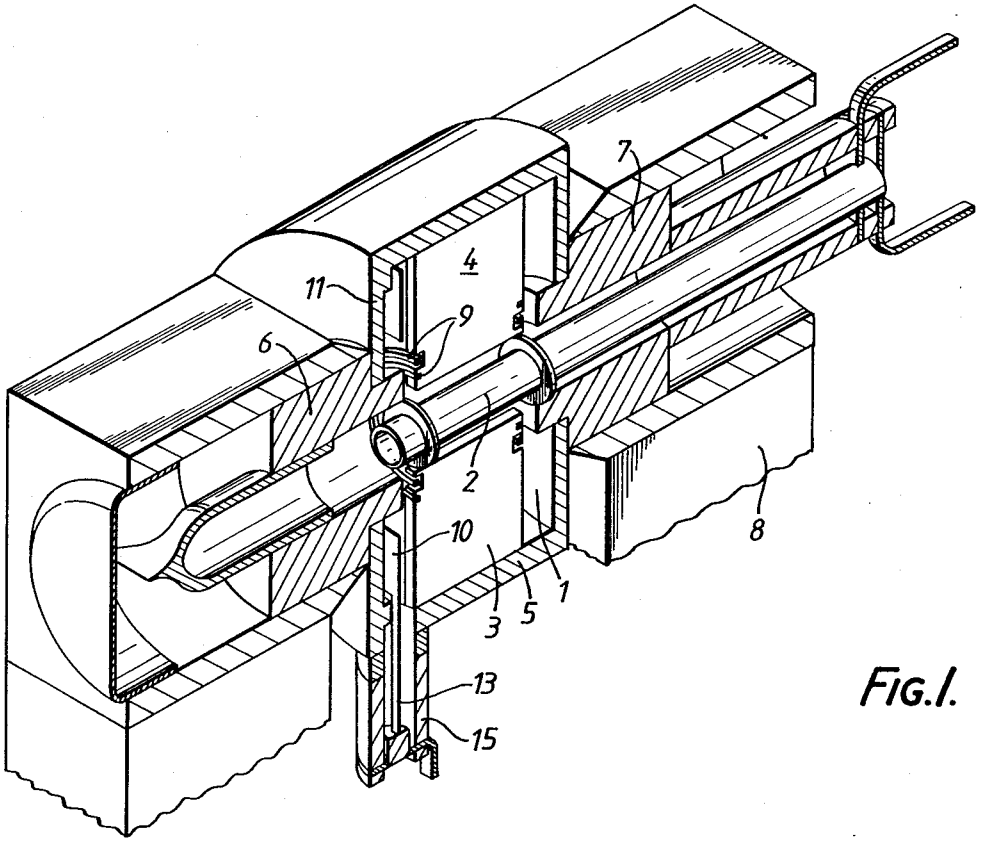
FIG. 1 is a perspective view, partly in section, of a magnetron in accordance with the invention.
Figure 2:
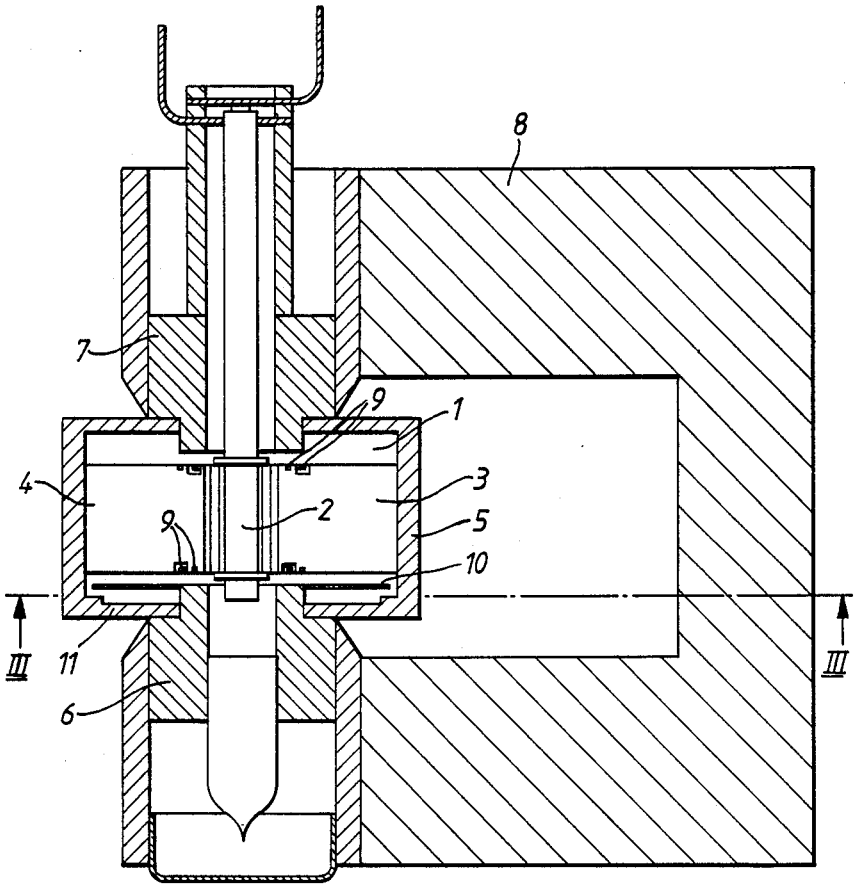
FIGS. 2 and 3 are longitudinal and transverse views respectively of the magnetron shown in FIG. 1.
Figure 3:
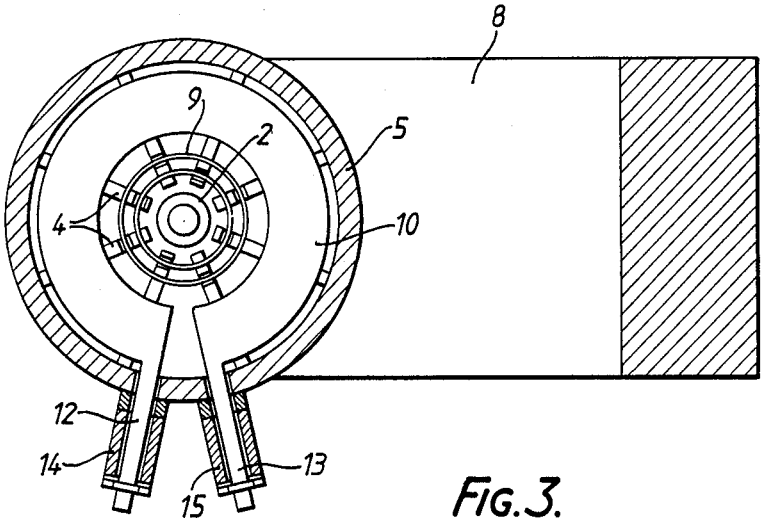

With reference to FIGS. 1,2 and 3, a magnetron of the anode vane type includes a generally annular cavity 1 within which is contained a cathode 2 arranged along its longitudinal axis and an anode 3 which comprises eight vane portions 4 and the wall 5 of the cavity 1. Two magnetic pole pieces 6 and 7 are arranged at each end of the cathode 2 and are designed to produce a substantially axial field in the interaction region of the magnetron. A U-shaped piece 8 provides a return path for the magnetic flux. Sets of anode straps 9 are included to connect alternate ones of the vanes 4 to control the mode of resonance of the magnetron.

A tuning member 10 is located between one of the end walls 11 of the cavity 1 and the vane structure 4, and is an annular plate which is split and has two extended portions or legs 12 and 13 on each side of the split. In this embodiment the legs 12 and 13 project radially, but they could be arranged to be parallel. The legs 12 and 13 extend from the cavity 1 in ceramic sleeves 14 and 15, being held in position there by insulating portions. Electrical connections are made to each leg to provide a current path around the tuning member 10.

During operation, when it is wished to tune the frequency of oscillation of an output signal of the magnetron, an electric current is passed along the path defined by the tuning member 10, producing a force on tuning member 10 which is dependent on the magnitude and direction of the current and the magnitude of the radial magnetic field component, as discussed above. Thus the tuning member 10 may be made to move towards or away from the resonant cavities defined by vanes 4 to provide tuning. As the legs 12 and 13 of the tuning member 10 are relatively long, movement of the tuning member 10 is substantially uniform across the cavity. When an ac current is applied, this results in tuning of the frequency over a range of frequencies, the member moving with simple harmonic motion.

Figure 4:
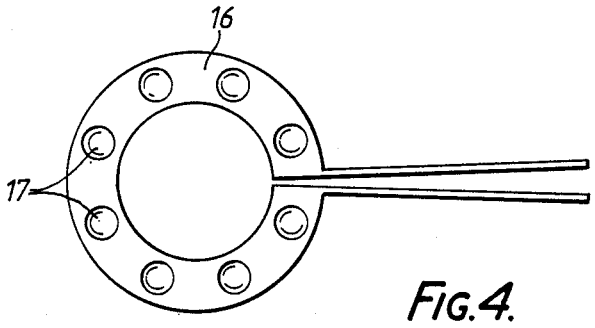
FIG. 4 shows a tuning member for use in a magnetron in accordance with the invention.

With reference to FIG. 4, in another embodiment of the invention a tuning member 16 is included which has a plurality of circular indentations 17 spaced around the annular plate. These present a greater current path length and thus allow the tuning range to be increased over that available with a wholly flat tuning member.

Figure 5:
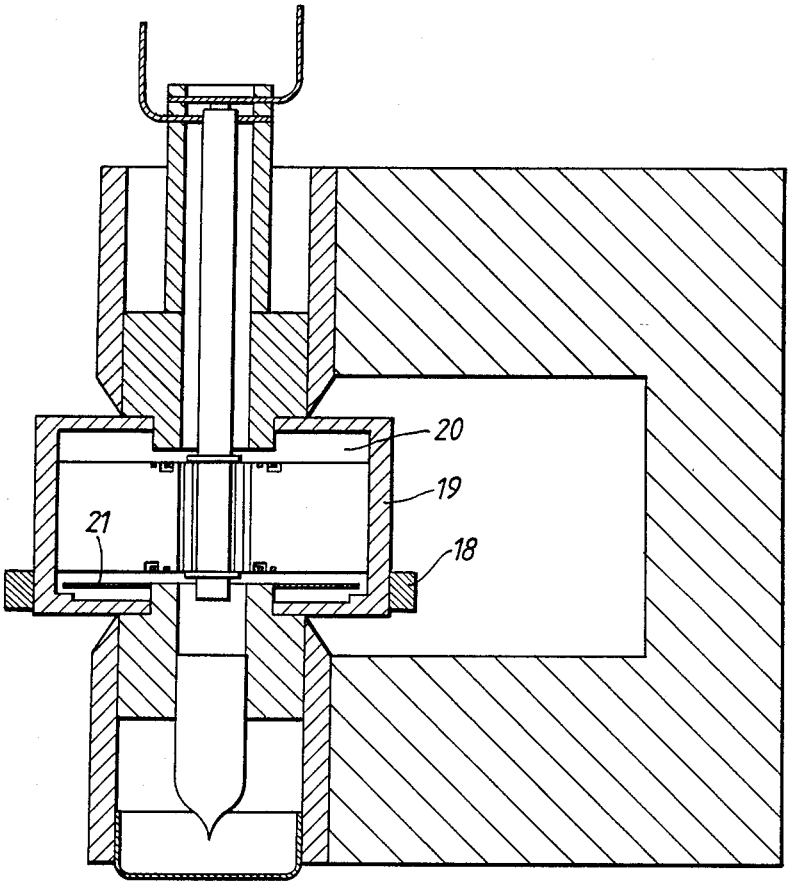
FIG. 5 is a schematic longitudinal section of another magnetron in accordance with the invention.

With reference to FIG. 5, another magnetron in accordance with the invention is similar to that described with reference to FIGS. 1, 2 and 3 and includes additional magnetic material, in the form of a ring 18 located around the cylindrical wall 19 of the annular cavity 20. The ring 18 is positioned at the end of the cavity 20 at which the tuning member 21 is located and acts to increase the radial magnetic field component at that region.

I claim:

1. A magnetron comprising: a resonant cavity; a tuning member arranged in a magnetic field and moveable relative to said resonant cavity, the frequency of oscillation of a microwave output signal of the magnetron being dependent on the position of said tuning member; and means arranged to transmit a current along a path substantially normal to a component of said magnetic field and defined by said tuning member, whereby the position of said tuning member is controlled.

2. A magnetron is claimed in claim 1 wherein said magnetic field component is substantially normal to said magnetic field at an interaction space of said magnetron.

3. A magnetron as claimed in claim 1 and including magnetic material arranged to increase the magnitude of said magnetic field component in the region of said tuning member compared to what it would otherwise be if said magnetic material were not present.

4. A magnetron as claimed in claim 3 wherein said magnetic field component is substantially normal to said magnetic field at an interaction space of said magnetron.

5. A magnetron as claimed in claim 4 wherein said magnetic material is in the form of a ring arranged around the outside of the anode structure of said magnetron.

6. A magnetron as claimed in claim 1 wherein said tuning member is substantially planar and has a configuration corresponding to the resonant cavity configuration of said magnetron.

7. A magnetron as claimed in claim 6 wherein said tuning member includes an indentation in its surface.

8. A magnetron as claimed in claim 6 wherein said tuning member is an annular plate having a radial split therein and having extensive portions at each side of said split, said annular plate being pivoted at said extensive portions.

9. A magnetron as claimed in claim 1 wherein said current is a dc current.

10. A magnetron as claimed in claim 1 wherein said current is an ac current.

* * * * *